United States Patent [19]

Price et al.

[11] Patent Number: 4,615,463

[45] Date of Patent: Oct. 7, 1986

[54] INSULATED CONTAINER FOR A FLUID RECEPTACLE

[75] Inventors: Humphrey W. Price, Pasadena, Calif.; Robert P. Wood, San Antonio, Tex.

[73] Assignee: Stephen A. Katz, San Antonio, Tex.

[21] Appl. No.: 759,232

[22] Filed: Jul. 26, 1985

[51] Int. Cl.[4] ..... B65D 25/34

[52] U.S. Cl. ..... 220/412; 220/90.2; 220/90.4

[58] Field of Search ..... 220/412, 90.4, 90.2, 220/90.3, 411; 215/12 R; 212/216

[56] References Cited

U.S. PATENT DOCUMENTS

| | | | |
|---|---|---|---|
| 209,851 | 11/1878 | Arnold | 220/90.4 |
| 727,212 | 5/1903 | Scott | 220/90.2 |
| 2,121,118 | 6/1938 | Cooper | 220/90.2 |
| 3,023,922 | 3/1962 | Arrington et al. | 220/90.2 |
| 3,905,511 | 9/1975 | Groendal | 220/90.2 |
| 4,057,167 | 11/1977 | Lee | 220/90.4 |
| 4,183,443 | 1/1980 | De Parales et al. | 220/90.4 |
| 4,194,627 | 3/1980 | Christensen | 220/412 |
| 4,322,015 | 3/1982 | Bailey | 220/90.2 |
| 4,561,563 | 12/1985 | Woods | 220/412 |

*Primary Examiner*—Joseph Man-Fu Moy
*Attorney, Agent, or Firm*—Gunn, Lee & Jackson

[57] ABSTRACT

The invention is an apparatus for controlling the temperature of a fluid contained in a receptacle. The fluid is accessible through an aligned container access port and receptacle access port. Heat exchange from the receptacle is minimized by a seal located about the container access port which conforms to the edges of the receptacle. The fluid may be heated or cooled by an appropriate temperature affecting means within the container.

12 Claims, 8 Drawing Figures

INSULATED CONTAINER FOR A FLUID RECEPTACLE

BACKGROUND OF THE INVENTION

The invention comprises a reusable portable apparatus for controlling the temperature of a fluid contained in a disposable receptacle such as a beverage can.

Conventional insulators keep the beverage cool by insulating it from the atmosphere but do not sufficiently encapsulate the beverage can to minimize heat exchange. Further, they are passive devices which do not themselves heat or cool the beverage. A fluid must be either cooled or heated before placement in a conventional insulator. This invention permits either controllable heating or cooling of the beverage or the maintenance of its precooled or preheated fluid temperature for a longer period of time than is possible in conventional insulators.

SUMMARY OF THE INVENTION

The invention is an apparatus for controlling the temperature of a fluid contained in a receptacle, such as a beverage can. The fluid is accessible through an aligned container opening and receptacle opening. Heat exchange through the container opening is minimized by a seal located about the container opening which conforms to the top and edges of the receptacle and also by a flap which covers the container opening. The fluid may be heated or cooled by an appropriate temperature effectuating means in the container.

The top of the container is detachably secured to the bottom of the container to allow fluid receptacles to be easily inserted in and removed from the container's bottom member. When the top is in place, it secures and encapsulates the receptacle within the container. A compartment to accomodate the temperature effectuating means, to either heat or cool the fluid, is located in the lower portion of the bottom of the container.

The invention provides a fast and convenient method of heating or cooling a canned fluid and maintaining its temperature. It is particularly useful where conventional cooling or heating methods are not possible or where a fluid temperature needs to be maintained over an extended period of time. Conventional portable container insulators do not cool or heat a fluid and maintain its temperature while allowing direct access to the fluid. The invention solves this problem by substantially encapsulating the fluid container in an insulator and using a temperature affecting means located within the container itself.

Another purpose of the invention is to actively control the temperature of the fluid while its receptacle is within the insulated container.

Additionally, the encapsulating design of the container in conjunction with its upper seal prevents condensation spilling out through the access port.

Other purposes will be apparent to those skilled in the art.

DETAILED DESCRIPTION OF THE DRAWINGS

Figure 1:
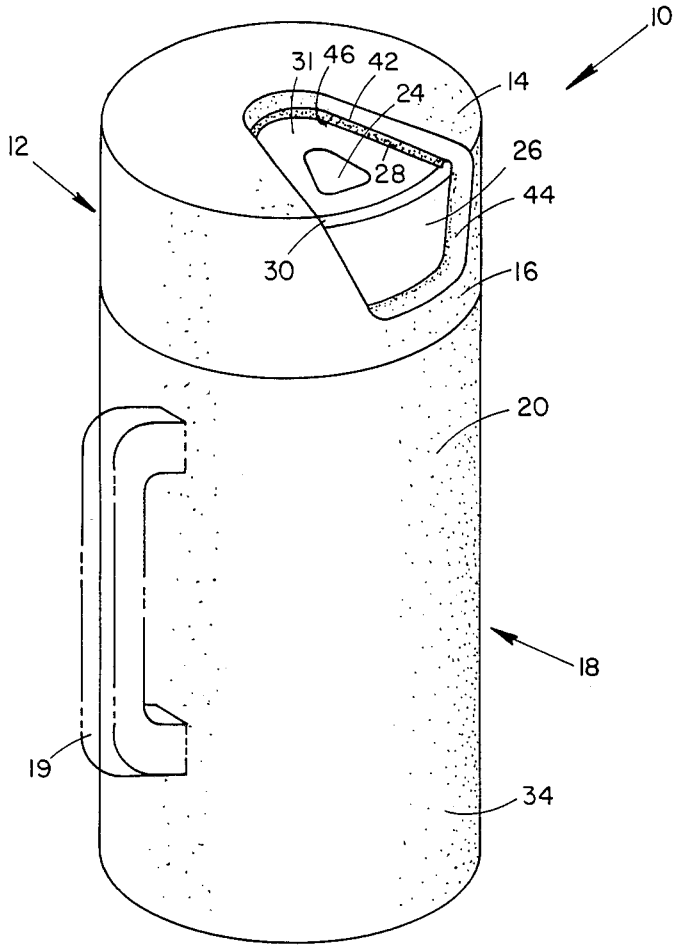

FIG. 1 shows the external features of the container 10 comprised of an upper member 12 and a bottom member 18. Upper member 12 has top 14, upper side 16 and container opening 24. Bottom member 18 has grip means 19 and lower portion 20.

Figure 2:
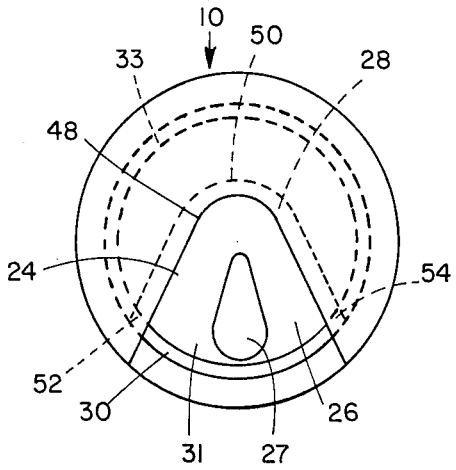

FIG. 2 shows a top view of container 10 with receptacle 26 inside of it. Receptacle opening 27 is aligned with container opening 24 to permit access to fluid contained in receptacle 26. Seal 28 is attached to the under side 46 of top 14 and is shown in relief. Seal 28 is shaped and sized to conform to access port 24 and to closely receive can edge 30 and can top 31.

Figure 3:
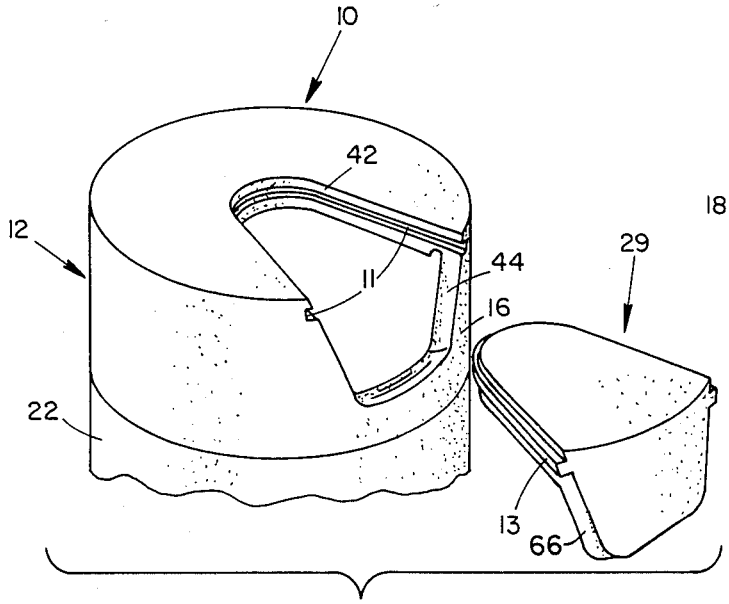

FIG. 3 is a side view of container 10 with flap member 29. Flap member 29 is slidable by tongue member 11 and groove member 13 into upper member 12 to cover access port 24. When flap 29 is in place, receptacle 26 is totally encapsulated.

Figure 4:
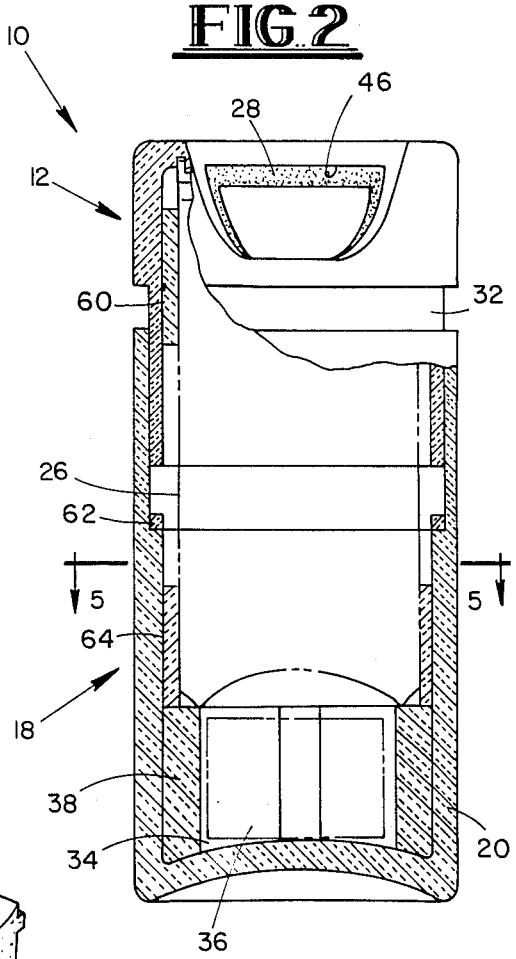

FIG. 4 shows a cross-sectional view of container 10 holding a typical cylindrical beverage can 26.

Figure 5:
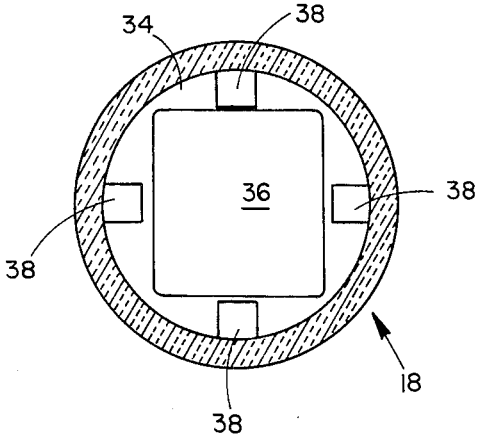

FIG. 5 shows a cross-sectional view of lower member 18 through compartment member 34 to show post members 38 and temperature affecting means 36.

Figure 6:
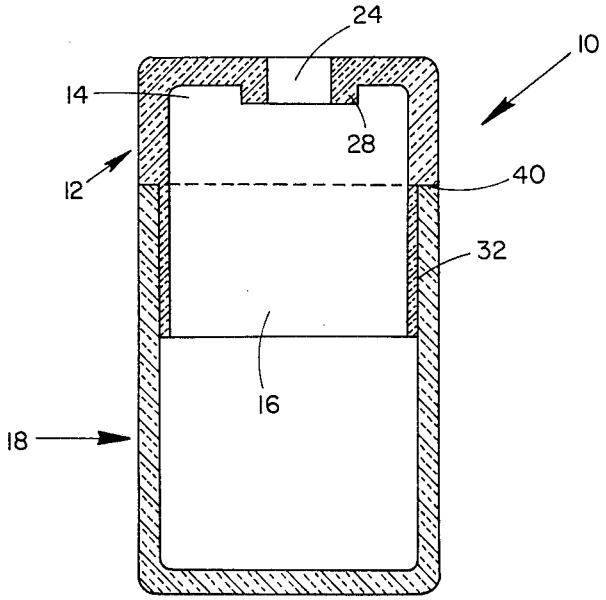

FIG. 6 shows an alternative embodiment with upper member 12 attached to bottom member 18 by the frictional engagement of interior sleeve 32 and the inside surface of bottom member 18. Shoulder 40 acts as a stop.

Figure 7:
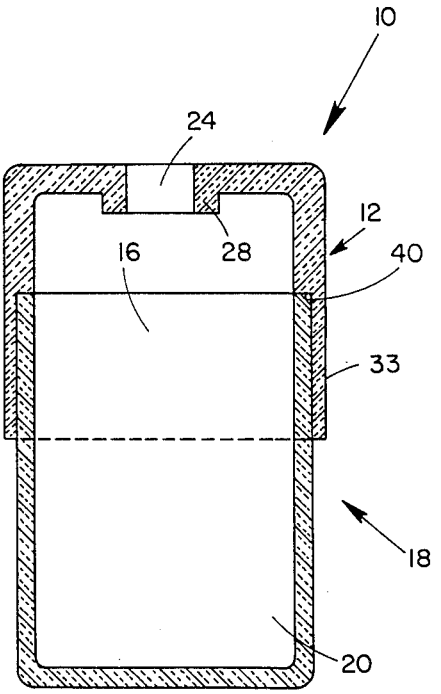

FIG. 7 shows an alternative embodiment where upper member 12 is attached to bottom member 18 by the frictional engagement of outer sleeve 33 and the outside surface of bottom member 18. Shoulder 40 acts as a stop.

Figure 8:
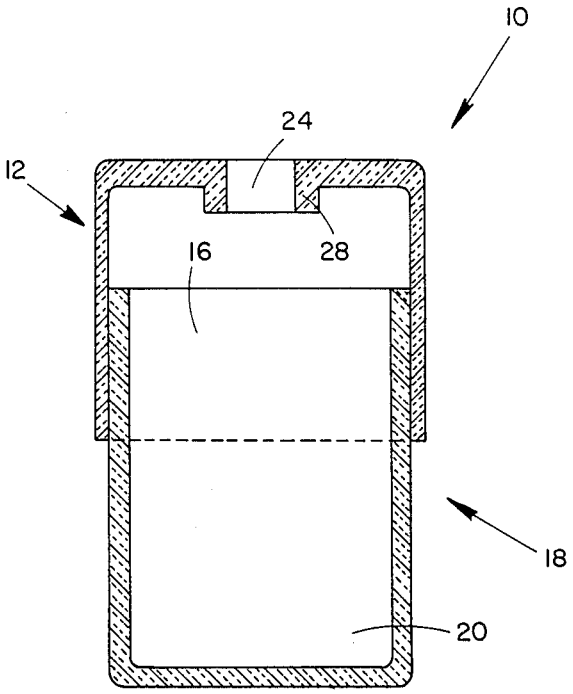

FIG. 8 shows an alternative adjustable embodiment with upper member 12 attached to bottom member 18 by the frictional engagement of the inner side of upper side 16 and the outside surface of lower member 18. There is not a stop in this configuration.

DETAILED DESCRIPTION OF THE INVENTION

The following discussion is in terms of the invention's preferred embodiment, which represents the best mode known to the applicants at the time of this application. In this detailed description of the preferred embodiment and its various species, reference is made to the attached several views wherein reference characters will be used to identify the components of the invention.

FIG. 1 shows an exterior view of container 10 for beverage can 26. Container 10 has upper member 12 with top 14 and upper side 16. Container opening 24 is located in top 12 and upper side 16 and is sized and shaped to allow access to the fluid in can 26. Container opening 24 has upper opening 42 and side opening 44. Upper opening 42 is located in top 12 and is designed and shaped to just accomodate the nose of an average adult when container 10 is tilted to drink from can 26 through can opening 27. Side opening 44 is located in upper side 16 and is designed and shaped to just accomodate the mouth of the average adult when drinking through can opening 27.

Container opening 24 can be adapted to a variety of different uses. For example, a spout can be attached to container opening 24 to allow pouring of a fluid contained in can 26. The spout can be of a variety of different lengths and size openings depending upon the intended use. Opening 24 may also be sized to accomodate children, nipples for formula bottles to be warmed, etc. One use is to have opening 24 in the middle of the top of the upper member to accomodate a formula bottle nipple FIG. 1 shows the almost complete encapsulation of can 26 within container 10. Seal 28 is located on under side 46 of top 14 and consists of material capable of conforming to the shape of the top of receptacle 26. Seal 28 has first side 48 and second side 50. First side 48 conforms to opening 24 and second side 50 is attached to under side 46. Seal 28 has first and second ends 52 and 54 which do not touch upper side 16. Notches 56 and 58 are found between first end 52 and upper side 16 and second end 54 and upper side 16, respectively. First and second notches 56 and 58 are shaped and sized to closely receive can edge 30.

Can edge 30 fits snugly within notches 56 and 58. Can top 31 fits snugly against seal 28. The side wall of can 26 fits snugly against upper side 16. These relationships collectively prevent movement of can 26 within container 10 and insulate it from the atmosphere. Seal 28 prevents liquid accumulations or condensation on top of can 26 from spilling out when container 10 is tipped to pour fluid out of can 26 and prevents the fluid from can 26 from spilling into container 10. Seal 28 may press can 26 downward and forward to give a tighter fit at side opening 44. This prevents air from circulating about can 26 and slows heat exchange between the fluid and the atmosphere.

Bottom member 18 is sized to securely hold can 26 without rattling. Compartment member 34 is sized to hold temperature affecting means 36 and has post member 38 to support can 26 above it.

FIG. 4 shows seal 28, first inner seal 60, second inner seal 62 and third inner seal 64 comprised of flexible materials and capable of holding receptacle 26 in proper alignment within the container 10 and substantially preventing condensation caused by the can 26 or a temperature affecting means 36 from spilling out of the container 10 when it is tilted during drinking.

Temperature affecting means 36 is sufficiently sized and is comprised of materials sufficient to permit it to control the temperature of the fluid in can 26. For the purpose of this description, "control" means to affect a difference in the fluid temperature due to its being heated or cooled by temperature affecting means 36. Temperature affecting means 36 must be sized to pass between post member 38 and fit within compartment member 34. Temperature affecting means 36 can be used in containers 10 with or without lower compartment member 34. Without lower compartment member 34 and support members, 37, 38, 39 and 41, can 26 sits directly on temperature affecting means 36.

Depending upon whether container 10 is used either to heat or to cool the fluid contained in can 26, the chemical recantants used in temperature affecting means 36 are either exothermic reactants or endothermic reactants. Alternative methods of heating or cooling such as ice, hot rocks or metal, etc are also appropriate if sized to fit within compartment member 34. Temperature affecting means 36 will typically be a chemical pack having a first compartment and a second compartment separated by a barrier, each compartment holding a predetermined quantity of chemical. The barrier between the compartments is easily broken by exerting pressure on the chemical pack 36, increasing internal pressure within one compartment relative to the other compartment. Once the barrier is broken, the chemicals mix initiating the reaction. Activation of chemical pack 36 can be by a number of alternative methods, including but not limited to the following methods:

(1) The bottom of the can 26 can be used as the pressure plate, activation being by pushing can 26 down into container 10 and squeezing chemical pack 36 between the can 26 and the bottom of the container 10.

(2) A pressure plate can be located between can 26 and chemical reaction pack 36. Pushing can 26 against the plate pressures chemical pack 36, breaks its internal barrier and mixes its chemical reactants and starts the reaction.

(3) A push button can be located outside of and through container 10. The distal end of the push button presses on chemical reaction pack 35 and breaks the barrier between the chemical compartments.

(4) A pull wick can be located outside and through container 10 attached to chemical pack 36. Pulling the wick breaks the barrier.

Alternatively, the container 10 and chemical pack 36 can be sized to permit placement of two packs in container 10; one for storage and one to heat or to cool if desired.

The material composition of bottom member 18 can be of any suitable insulating material such as styrofoam. The interior of bottom member 18 is sized and shaped to conform to the intended receptacle. The exterior configuration of bottom member 18 can be of any desired shape, for example, hexagonal or round. Attachments to aid in holding container 10 such as handle 19 can be added.

FIGS. 6, 7, and 8 show alternative configurations of slidably attaching upper member 12 and bottom member 18 by frictional engagement. In the preferred embodiment, FIG. 6, sleeve 32 extends from upper side 16 into bottom member 18 to shoulder stop 40. Sleeve member 32 extends from upper side 16 into bottom member 18 and allows container 10 to be adjusted to closely enclose can 26.

FIG. 7 shows an alternative configuration where upper member 12 slides externally over bottom member 18. Outer sleeve member 33 extends from upper side 16 over lower portion 20 of member 18 to shoulder stop 40.

Flap member 29 in FIG. 3 covers access port 24 to completely encapsulate can 26 within container 10. Flap 29 can be removed to permit access to can 26. Flap 29 can either be to top member 12, pivotally mounted either inside or outside of the upper member to be moveable rotatably over and away from the access port or, as shown in FIG. 3, can be slidable into upper member 12 by using tongue member 11 and groove member 13 and a negatively sloping lower lip 66 to retain it in position.

In the preferred embodiment, the invention's approximate dimensions for a container with a bottom compartment designed to hold a cylindrical beverage can approximately 2.5 inches in diameter and 4.75 inches in length, are approximately as follows: length 7 inches, inner diameter 2.7 inches, outer diameter 3.25 inches. Dimensions of the upper member are, length 3.25 inches, (including sleeve length 1.75 inches and upper side length 1.5 inches), sleeve thickness 0.12 inches, upper side thickness 0.3 inches. Dimensions of the bottom member are, 5.75 inches in length (including sleeve holder 1.75 inches), thickness of sleeve holder 0.12 inches, thickness of lower member 0.3 inches, support members 0.5 inches wide, 0.5 inches deep and 1 inch high uniformly spaced along the bottom of the inner face of the bottom member.

The thickness of the bottom is 0.3 inches. The overall length of an embodiment without a bottom compartment is 6 inches.

The preferred material comprising container 10 is expanded polystyrene foam preferrably $\frac{1}{8}$ to $\frac{1}{2}$ inches thick along the container's walls and top and 3/16 to 2 inches thick at the base. For heavy duty use, a durable shell or coating can be added to the outside of container 10.

The preferrable chemical pack contains chemicals in two separate compartments within a 2 mil thick plastic container divided by a breakable 0.5 mil thick plastic internal barrier. Each compartment holds a different per unit volume of chemical. Because the largest temperature differential with the outside will be in the bottom where the chemical pack is located, the bottom may be concave to minimize contact with any surface it is set upon.

Those skilled in the art will appreciate that the invented container, and its parts can be of any size, composition, shape or arrangement consistent with the spirit and scope of the claims. Variations in the sizes and proportions set forth above consistent with the spirit of the disclosure can be made to accomodate other types of containers for other kinds of purposes.

While the invention has been described in connection with the preferred embodiment, it is not intended to limit the invention to the particular form set forth, but, on the contrary, is intended to cover such alternatives, modifications, and equivalents as may be included within the spirit and scope of the invention as defined by the appended claims.

What is claimed is:

1. A reusable insulated container capable of accepting and holding a removable fluid receptacle with protruding edges containing a fluid and capable of controlling the fluid temperature, comprising:

an upper member comprised of a top connected to an upper side and a bottom member comprised of a bottom connected to a bottom side, said upper member and said bottom member being detachably securable to each other, said top, upper side, bottom, and bottom side being sized and shaped to be capable of accepting and holding said receptacle within said container and to retard heat exchange between said receptacle and outside of said container;

an access port located in said upper member which is capable of being aligned with an opening in said receptacle and is sufficiently large and sufficiently shaped to permit useful direct access to said fluid from outside of said receptacle and said container when aligned with said receptacle opening;

a seal located on the lower face of said top, said seal having a first side, a second side, a first end and a second end, said first side conforming to said access port, said first end being closely adjacent to said upper side and one side of said access port to form a first notch between said upper side and said first end, said second end being closely adjacent to said upper side and the other side of said access port to form a second notch between said upper side and said second end, said first and second notches being shaped and sized to closely receive said protruding edge of said receptacle, said second side being sized and shaped to not obstruct said protruding edge and to permit said seal to closely abut the top of said receptacle and said protruding edge to fit within said first and second notches.

2. The invention of claim 1 wherein said access port has an upper portion and a side portion, said upper portion is located in said top and is sized and shaped to accomodate the nose of an average adult human when said receptacle is tilted to allow drinking from said receptacle through said access port, said side portion located in said upper side and is sized and shaped to accomodate the mouth of said human when said human drinks through said access port from said receptacle.

3. The invention as recited in claim 2 wherein said means for detachably securing said upper member to said bottom member comprises an upper inner sleeve portion of said upper side, said upper inner sleeve being closely insertable within an annulus of said bottom side and being adjustable therein.

4. The invention as recited in claim 3 wherein said bottom member further comprises a compartment member sized and shaped to receive a temperature affecting means of sufficient size and composition to change the temperature of the fluid; and wherein said container has a temperature affecting means within said compartment member which is capable of changing the temperature of said fluid.

5. The invention of claim 4 wherein said compartment member contains at least one support member to support said receptacle above said temperature affecting means.

6. The invention of claim 5 wherein said temperature affecting means is an endothermic reaction pack sufficient to cool said fluid.

7. The invention of claim 5 wherein said temperature affecting means is an exothermic chemical reaction pack sufficient to heat said fluid.

8. The invention of claim 5 wherein said temperature affecting means is self contained in heavy strength platic, is color coded to indicate whether said temperature affecting means is an endothermic or an exothermic reaction pack and is activated by breaking an internal barrier within said temperature affectuating means to initiate a chemical reaction between nontoxic chemicals.

9. The invention of claim 2 further comprising a flap member connected to said upper member which is capable of covering said access port to encapsulate said receptacle within said container.

10. The invention of claim 2 wherein said upper side has a continuous first inner flexible seal and said bottom side has a second inner flexible seal and a third continuous inner seal is positioned between said upper member and said bottom member, said first, second and third inner seals being capable of holding said receptacle in proper alignment within said container and of substantially preventing condensation within said container from leaking out of said container.

11. The invention of claim 2 wherein said means for detachably securing said upper member to said bottom member comprises said upper member fitting closely over the outside of said lower member and being adjustable thereon.

12. The invention of claim 2 wherein the bottom of said container is concave to minimize the surface area of said container having direct contact with flat surface said container may be set on.

* * * * *